US011239001B2

(12) United States Patent
Liu et al.

(10) Patent No.: US 11,239,001 B2
(45) Date of Patent: Feb. 1, 2022

(54) METHOD FOR GENERATING EXTREME ULTRAVIOLET RADIATION AND AN EXTREME ULTRAVIOLET (EUV) RADIATION SOURCE

(71) Applicant: TAIWAN SEMICONDUCTOR MANUFACTURING COMPANY LTD., Hsinchu (TW)

(72) Inventors: Tzu Han Liu, Tainan (TW); Chih-Wei Wen, Tainan (TW); Chung-Hung Lin, Tainan (TW)

(73) Assignee: TAIWAN SEMICONDUCTOR MANUFACTURING COMPANY LTD, Hsinchu (TW)

( * ) Notice: Subject to any disclaimer, the term of this patent is extended or adjusted under 35 U.S.C. 154(b) by 0 days.

(21) Appl. No.: 16/144,540

(22) Filed: Sep. 27, 2018

(65) Prior Publication Data

US 2020/0105431 A1 Apr. 2, 2020

(51) Int. Cl.
*G21K 1/00* (2006.01)
*H05G 2/00* (2006.01)

(52) U.S. Cl.
CPC ..... *G21K 1/003* (2013.01); *H05G 2/008* (2013.01)

(58) Field of Classification Search
None
See application file for complete search history.

(56) References Cited

U.S. PATENT DOCUMENTS 7,307,263 B2 * 12/2007 Bakker ..... G03F 7/70908 250/492.2
8,158,959 B2 * 4/2012 Asayama ..... H05G 2/003 250/365
2005/0140945 A1 * 6/2005 Banine ..... G03F 7/70916 355/30
2007/0251543 A1 * 11/2007 Singh ..... G21K 1/003 134/1
2009/0261277 A1 * 10/2009 Soumagne ..... G03F 7/70033 250/504 R
2010/0108918 A1 * 5/2010 Nagai ..... G03F 7/70033 250/504 R
2010/0176312 A1 * 7/2010 Komori ..... G03F 7/70033 250/504 R
2011/0253913 A1 * 10/2011 Nagai ..... H05G 2/003 250/504 R (Continued)

*Primary Examiner* — Brooke Purinton
(74) *Attorney, Agent, or Firm* — WPAT, P.C., Intellectual Property Attorneys; Anthony King

(57) ABSTRACT

A method for generating extreme ultraviolet (EUV) radiation includes introducing a fuel droplet; applying a first laser beam to strike the fuel droplet at a location to generate EUV radiation and form a movable debris of the fuel droplet; and forming an energy field proximal to the location of the first laser beam strike to trap the movable debris. An EUV radiation source includes a fuel droplet generator, a first laser, a collector and an energy field. The fuel droplet generator is configured to provide a fuel droplet. The first laser is configured to generate a first laser beam to strike the fuel droplet at a location to generate EUV radiation and form a movable debris. The collector is configured to reflect the EUV radiation. The energy field is configured to trap the movable debris, wherein the energy field is proximal to the location of the first laser beam strike.

20 Claims, 7 Drawing Sheets

(56) References Cited

U.S. PATENT DOCUMENTS

| | | | | |
|---|---|---|---|---|
| 2011/0309260 | A1* | 12/2011 | Nishisaka | G03B 27/54<br>250/372 |
| 2012/0146507 | A1* | 6/2012 | Yanagida | H05G 2/003<br>315/111.01 |
| 2012/0243566 | A1* | 9/2012 | Hori | H01S 3/10061<br>372/27 |
| 2012/0248343 | A1* | 10/2012 | Nagai | H05G 2/003<br>250/504 R |
| 2013/0313423 | A1* | 11/2013 | Umstadter | H05G 2/003<br>250/282 |
| 2016/0209753 | A1* | 7/2016 | Zhao | G03F 7/70033 |

* cited by examiner

METHOD FOR GENERATING EXTREME ULTRAVIOLET RADIATION AND AN EXTREME ULTRAVIOLET (EUV) RADIATION SOURCE

BACKGROUND

Extreme ultraviolet (EUV) radiation, e.g., electromagnetic radiation having wavelengths of around 50 nm or less, and including light at a wavelength of about 13.5 nm, can be used in photolithography processes to produce extremely small features in substrates such as silicon wafers. Methods for generating EUV radiation include converting a fuel material from a liquid state into a plasma state. In the plasma state, the fuel material emits photons having the desired wavelength, which comprise the EUV radiation.

BRIEF DESCRIPTION OF THE DRAWINGS

Aspects of the present disclosure are best understood from the following detailed description when read with the accompanying figures. It should be noted that, in accordance with the standard practice in the industry, various features are not drawn to scale. In fact, the dimensions of the various features may be arbitrarily increased or reduced for clarity of discussion.

DETAILED DESCRIPTION

Figure 1:
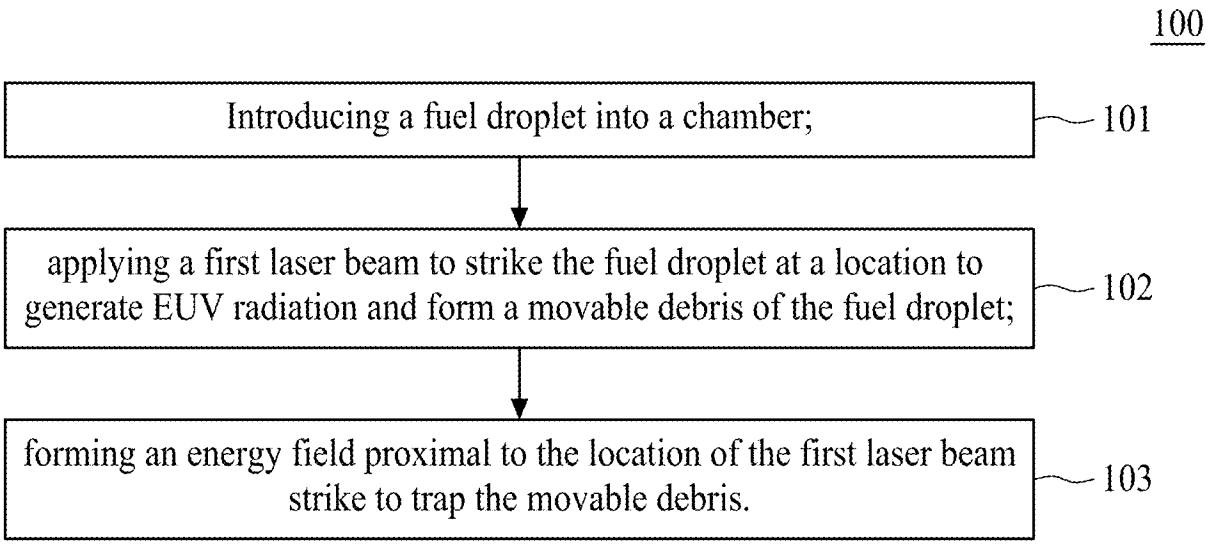
FIG. 1 is a flowchart representing a method for generating EUV radiation according to aspects of the present disclosure in one or more embodiments.

The following disclosure provides many different embodiments, or examples, for implementing different features of the provided subject matter. Specific examples of elements and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper," "on" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

As used herein, terms such as "first," "second" and "third" describe various elements, components, regions, layers and/or sections, but these elements, components, regions, layers and/or sections should not be limited by these terms. These terms may be only used to distinguish one element, component, region, layer or section from another. The terms such as "first," "second" and "third" when used herein do not imply a sequence or order unless clearly indicated by the context.

As used herein, the terms "approximately," "substantially," "substantial" and "about" are used to describe and account for small variations. When used in conjunction with an event or circumstance, the terms can refer to instances in which the event or circumstance occurs precisely as well as instances in which the event or circumstance occurs to a close approximation.

A method for generating extreme ultraviolet (EUV) radiation generally includes a fuel droplet generator that provides a plurality of fuel droplets to a chamber. A first laser is configured to generate a first laser beam directed toward the plurality of fuel droplets. As the fuel droplets enter the chamber, the first laser beam strikes the fuel droplets and heats the fuel droplets to a critical temperature that causes atoms of the fuel to shed their electrons and form plasma of ionized fuel droplets. The plasma of ionized fuel droplets emits photons having a wavelength less than 50 nm, which is provided as EUV radiation. A collector is configured to reflect the EUV radiation toward an exit of the chamber and onto a semiconductor workpiece.

In some embodiments, when the fuel droplets are struck by the laser beam, fuel debris from the strike may splash around the chamber and the collector. If the fuel debris collects on the collector, the collector may lose reflectivity and require replacement. Replacement of the collector is a time-consuming process that requires stopping the generation of EUV radiation.

Typically, when the fuel droplet includes tin, a method for removing fuel debris from the chamber includes stopping the supply of the laser beam and the supply of the fuel droplets, and purging the chamber by introducing $H_2$ buffer gas into the chamber. In some embodiments, the $H_2$ buffer gas is directed to flow away from the collector and decomposed into hydrogen ions. In some embodiments, the hydrogen ions may react with tin debris to form $SnH_4$, which can be purged away. However, the aforementioned method requires the use of a large amount of $H_2$ buffer gas and requires stopping generation of EUV radiation, resulting in a significant increase in cost.

The present disclosure therefore provides a method for generating EUV radiation and an EUV radiation source. A method for generating EUV radiation includes introducing a fuel droplet into a chamber, and applying a first laser beam striking the fuel droplet at a location to generate EUV radiation and form a movable debris of the fuel droplet. The method further includes forming an energy field proximal to the location of the strike to trap the movable debris. Accordingly, the collector contamination issue is mitigated.

Figure 2:
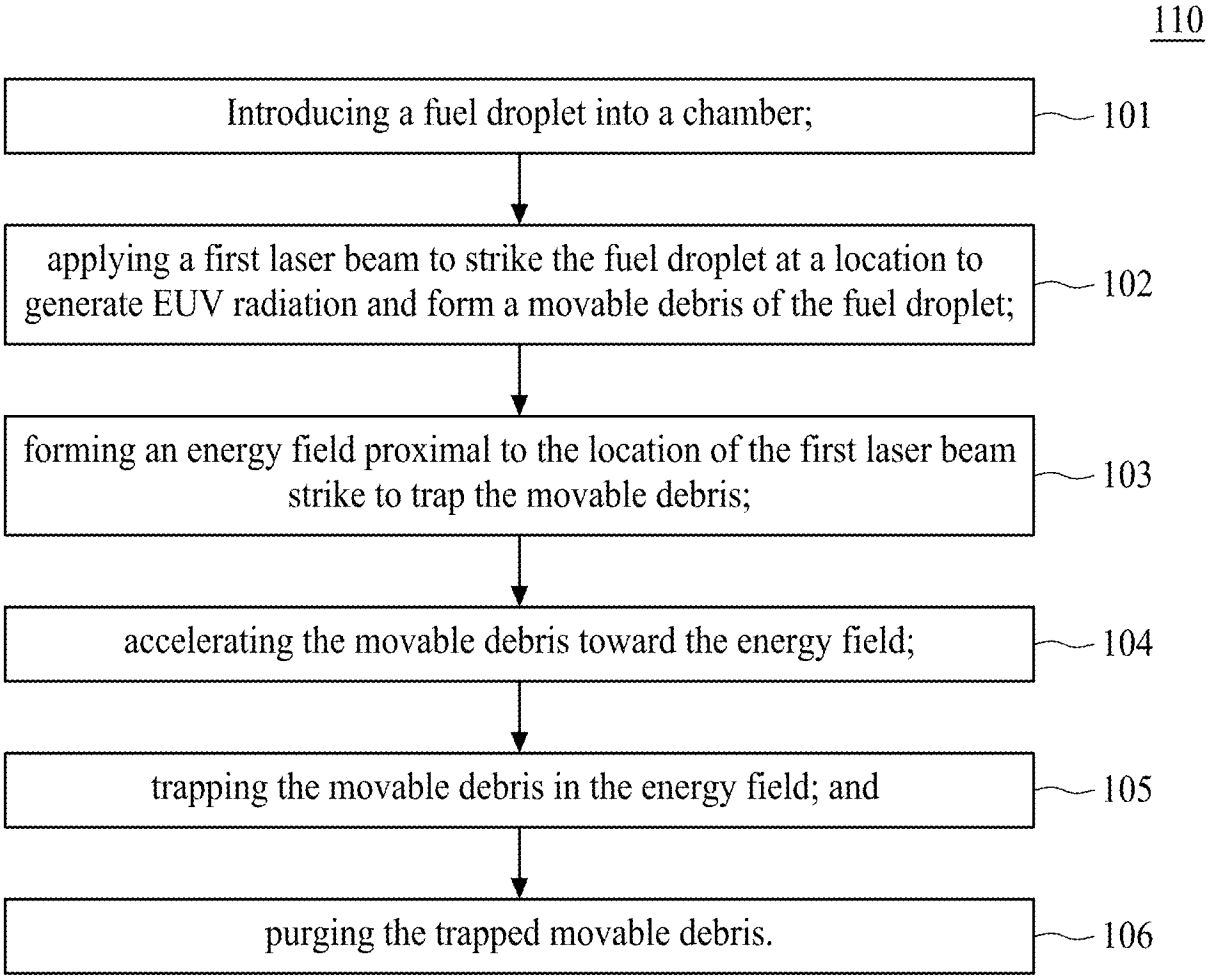
FIG. 2 is a flowchart representing a method for generating EUV radiation according to aspects of the present disclosure in one or more embodiments.
Figure 3:
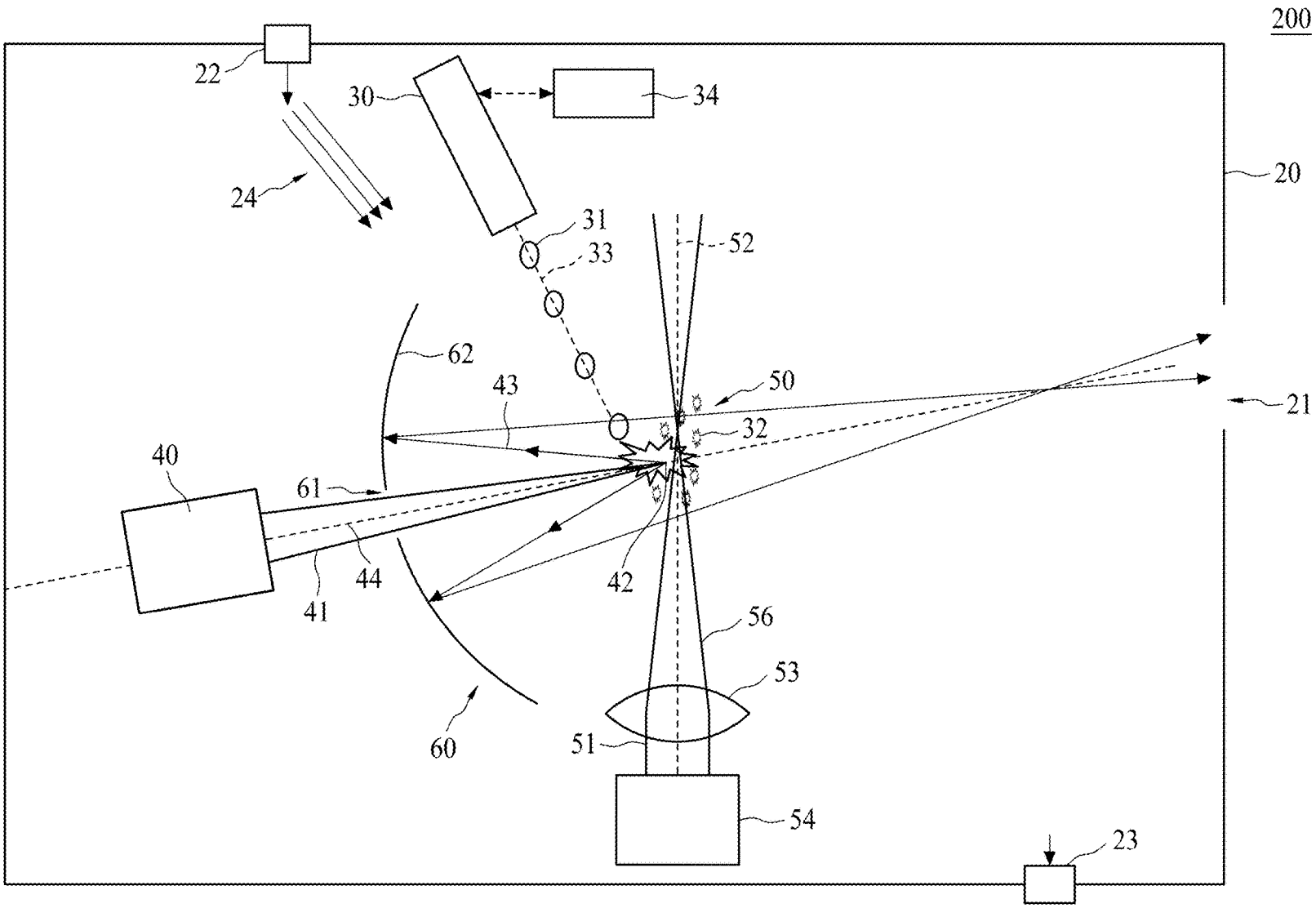
FIG. 3 illustrates an EUV radiation source according to aspects of the present disclosure in one or more embodiments.

FIG. 1 is a flowchart of a method 100 according to an embodiment of the present disclosure in which an energy field is formed in a chamber. FIG. 2 is a flowchart of a method 110 according to another embodiment of the present disclosure in which an energy field is formed in a chamber. FIG. 3 is a schematic drawing illustrating an EUV radiation source 200 according to aspects of the present disclosure in some embodiments, wherein either method 100 or method 110 can be implemented. In the present disclosure, methods 100 and method 110 for generating EUV radiation are disclosed. In some embodiments, movable debris may be trapped while generating the EUV radiation by the method 100 or the method 110. The methods 100 and 110 include a number of operations and the description and illustration are not deemed as a limitation of the sequence of the operations. The method 100 includes a number of operations 101, 102 and 103 as shown in FIG. 1. The method 110 includes a number of operations 101 to 106 as shown in FIG. 2.

The methods 100 and 110 begin with operation 101, in which a fuel droplet 31 is introduced into a chamber 20. In some embodiments, the fuel droplet 31 is provided from a fuel droplet generator 30. Methods 100 and 110 continue with operation 102, in which a first laser beam 41 is generated and strikes the fuel droplet 31 at a location 42 to generate EUV radiation 43 and form a movable debris 32 of the fuel droplet 31.

Referring to FIG. 3, the EUV radiation source 200 includes a fuel droplet generator 30 configured to provide a fuel droplet 31 to a chamber 20, and a first laser 40 configured to generate a first laser beam 41, which strikes the fuel droplet 31 at the location 42 to generate EUV radiation 43 and form a movable debris 32 of the fuel droplet 31. The EUV radiation source 200 further includes a collector 60 configured to reflect the EUV radiation 43 toward an exit aperture 21 of the chamber 20, and an energy field 50 configured to trap the movable debris 32, wherein the energy field 50 is proximal to the location 42 of the first laser beam strike.

In some embodiments, the chamber 20 is configured to receive the fuel droplet generator 30, the first laser 40, and the energy field 50, but the disclosure is not limited thereto. In some embodiments, the chamber 20 is held under vacuum (e.g., at a pressure of less than $10^{-2}$ mbar). In some embodiments, the chamber 20 is a high vacuum chamber. In some embodiments, the EUV radiation source 200 includes the fuel droplet generator 30 configured to provide a plurality of the fuel droplets 31 to the chamber 20 along a first trajectory 33. In some embodiments, the first trajectory 33 may be in a substantially same direction as a gravitational force. In other embodiments, the first trajectory 33 may be in a different direction from the gravitational force. In some embodiments, the fuel droplet generator 30 is configured to provide fuel droplets 31 having a diameter of less than or equal to approximately 20 microns. In some embodiments, the fuel droplets 31 include tin.

In some embodiments, the EUV radiation source 200 further includes a droplet metrology system 34 configured to determine the position and/or the first trajectory 33 of the plurality of fuel droplets 31. In some embodiments, information from the droplet metrology system 34 may be provided to the laser source 40, which can then adjust the position of the first laser beam 41 to intersect the first trajectory 33 of the plurality of fuel droplets 31.

The first laser beam 41 strikes the plurality of fuel droplets 31 to generate plasma of ionized fuel droplets 31 and movable debris 32. The plasma emits EUV radiation. Plasma can be formed in any suitable manner. In some embodiments, the EUV radiation 43 may have a wavelength between about 3 nm and about 50 nm. In some embodiments, the EUV radiation may have a wavelength between about 3 nm and about 15 nm. In some embodiments, the EUV radiation 43 may have a wavelength of approximately 13.5 nm. In some embodiments, the wavelength of the first laser beam 41 is 1064 nm or 266 nm. In some embodiments, the first laser beam 41 may include a carbon dioxide ($CO_2$) laser. In some embodiments, the first laser beam 41 may have principal wavelength bands centered around a range of between approximately 9 um and approximately 11 um and an energy of greater than or equal to approximately 11.9 MeV.

Figure 4:
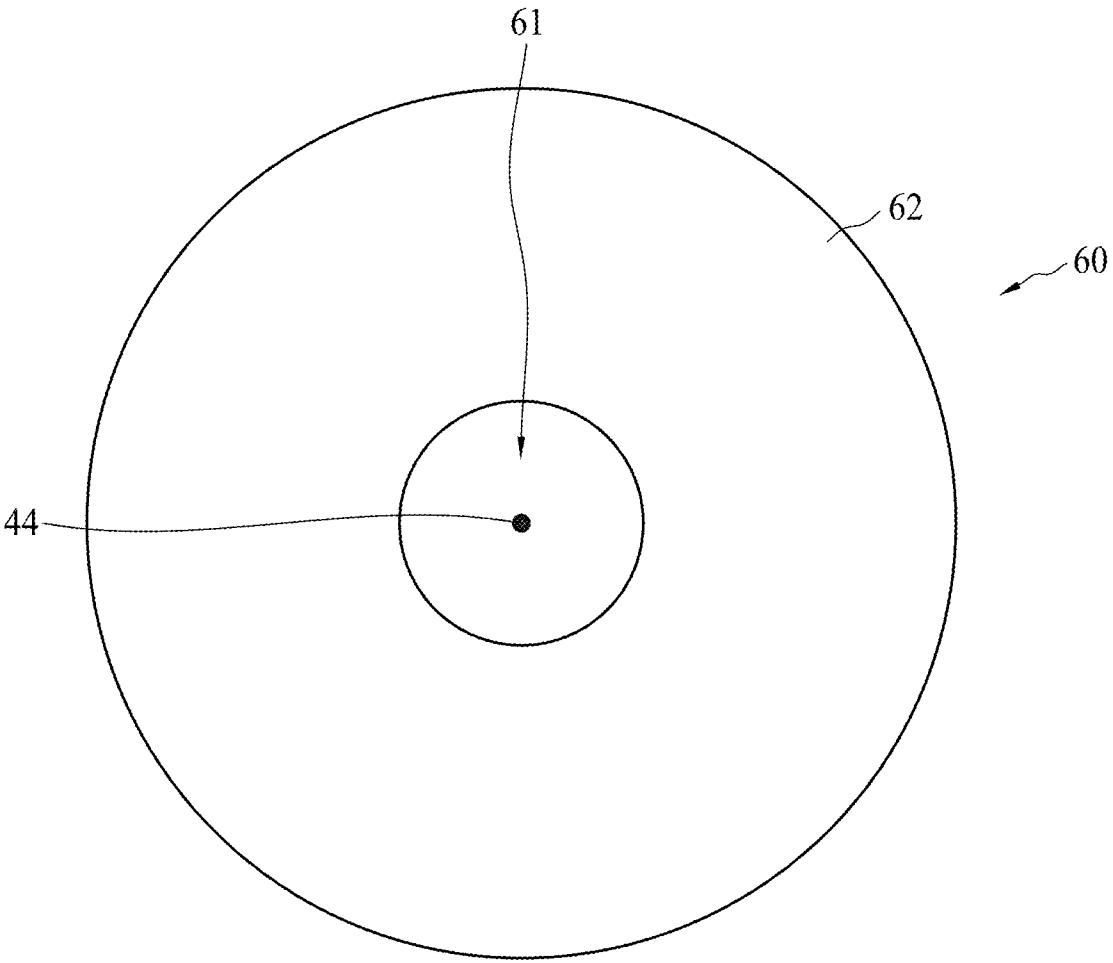
FIG. 4 illustrates a collector in accordance with embodiments of the present disclosure.

Please refer to FIGS. 3 and 4, wherein FIG. 4 is a top view of a collector 60. In some embodiments, the collector 60 is detachable from the chamber 20. The collector 60 is configured to reflect the EUV radiation 43 toward the exit aperture 21 of the chamber 20. In some embodiments, the collector 60 is an optical element. In some embodiments, the collector 60 may be a normal incidence reflector such as, for example, a mirror. In some embodiments, the collector 60 has a mirror surface 62. In some embodiments, the mirror surface 62 of the collector 60 is generally dish-shaped. In some embodiments, the mirror surface 62 is an ellipsoid. In some embodiments, the mirror surface 62 has a solid angle in the range from about 1 to about 3 steradians. In some embodiments, the collector 60 has an opening 61 for allowing the laser beam 41 to pass through. The position of the opening 61 is not particularly limited. In some embodiments, the opening 61 is at the center of the collector 60.

Referring back to FIGS. 1 to 3, in some embodiments, operations 101 and 102 of the present methods include focusing the first laser beam 41 from the first laser source 40 on a location 42, and shooting the fuel droplet 31 to the location 42. The first laser beam 41 strikes the fuel droplets 31 at the location 42 to generate plasma, which emits EUV radiation 43. In some embodiments, the EUV radiation 43 is widely scattered and reflected by the mirror surface 62 of the collector 60 to provide reflected EUV radiation 43. The collector 60 collects the EUV light 43 by reflecting and focusing the EUV radiation 43, causing the EUV radiation 43 to exit the chamber 20 via an exit aperture 21. In some embodiments, the laser source 40, the opening 61 of the collector 60, the location 42 and the exit aperture 21 of the chamber 20 are arranged along an axis of symmetry 44.

In some embodiments, the location 42 is located in the chamber 20. In other words, the first laser beam strike occurs in the chamber 20. In some embodiments, the movable debris 32 is generated at the location 42.

Methods 100 and 110 continue with operation 103, in which an energy field 50 is formed proximal to the location 42 of the first laser beam strike to trap the movable debris 32. In order to trap the movable debris 32, the energy field 50 is applied proximal to the location 42 of the first laser beam strike to trap the movable debris 32 in a contactless fashion, keeping the movable debris 32 from scattering throughout the chamber 20. The movable debris 32 may be attracted by the energy field 50 and move toward the energy field 50. In some embodiments, the operations 101, 102 and 103 can be performed simultaneously.

In some embodiments, the energy field 50 is an optical trap. In some embodiments, the energy field 50 is formed by means of a second laser beam 51 that creates optical tweezers or an optical trap. The technology relating to optical tweezers, which capture or control microscopic objects by laser beam without mechanically contacting the microscopic objects, is mostly used in the fields of micro-electrical engineering and bio-medicine. When a microscopic object, such as the movable debris 32, is projected by a laser beam, the microscopic object will move toward the part of the laser beam that has greater intensity; therefore a capturing effect on the microscopic object results. With the change in the gradient of the intensity of the laser beam, an interaction is generated between the laser beam and the microscopic object projected by the laser beam. In addition, the movement of many microscopic objects in a multi-dimensional space can be controlled at the same time. In some embodiments, the optical tweezers hold the movable debris 32 at the energy field 50. In some embodiments, the optical tweezers are in arbitrary three-dimensional configurations. In some embodiments, the energy field 50 includes an optical vortex. In some embodiments, the energy field 50 includes optical vortex tweezers.

In some embodiments, operation 103 further includes introducing the second laser beam 51 into the chamber 20, wherein the wavelength of the second laser beam 51 is different from the wavelength of the first laser beam 41. In some embodiments, the second laser beam 51 does not affect the first laser beam 41, and the second laser beam 51 does not affect the generation of EUV radiation 43. In some embodiments, the second laser beam 51 has a wavelength of 532 nm. In some embodiments, the energy field 50 is generated by focusing the second laser beam 51. In some embodiments, the second laser beam 51 may be directed along a second trajectory 52. In some embodiments, the second trajectory 52 may be in a substantially same direction as a gravitational force. In other embodiments, the second trajectory 52 may be in a different direction than the first trajectory 33. In other embodiments, the second trajectory 52 may be in a same direction as the first trajectory 33. In some embodiments, the EUV radiation source 200 includes a second laser 54 configured to provide the second laser beam 51 along a second trajectory 52.

In some embodiments, the energy field 50 is formed by passing the second laser beam 51 through a first optical element 53. In some embodiments, the first optical element 53 makes the second laser beam 51 highly focused to form the energy field 50. In some embodiments, the first optical element 53 is a convergent lens. In some embodiments, the energy field 50, such as optical tweezers, may be placed anywhere within the convergent lens' focal volume by appropriately selecting the propagation direction and degree of collimation of the second laser beam 51.

In some embodiments, the highly focused second laser beam 51 includes a narrowest point, which known as a beam waist (not shown). The beam waist contains a very strong energy field gradient. In some embodiments, the movable debris 32 is attracted along the gradient to the strongest region of the energy field 50, which is at the center of the beam waist. For quantitative scientific measurements, the movable debris 32 is manipulated in such a way that the movable debris 32 rarely moves far from the beam waist. This is because the force applied to the movable debris 32 is linear with respect to its displacement from the beam waist as long as the displacement is small.

Method 110 continues with operation 104, in which the movable debris 32 is accelerated toward the energy field 50. In some embodiments, the operations 101, 102, 103 and 104 can be performed simultaneously. In some embodiments, the method further includes acceleration of the movable debris 32 by the second laser beam 51, but the disclosure is not limited thereto. When the movable debris 32 is generated, it has a predetermined speed. The direction of the predetermined speed is determined by the direction in which the first laser beam 41 and the fuel droplet 31 are supplied. After the movable debris 32 is influenced by the energy field 50 formed by the second laser beam 51, the movable debris 32 accelerates toward the energy field 50. In some embodiments, the method further includes accelerating the movable debris 32 to a speed greater than the predetermined speed.

In some embodiments, the method further includes providing an optical-to-mechanical energy to the movable debris 32 by the second laser beam 51. In particular, the optical energy is provided by the second laser beam 51, and the optical energy is converted into the mechanical energy to move the movable debris 32.

In some embodiments, the method further includes deforming the movable debris 32 into a shape different from the shape of the fuel droplet 31. In this case, the power of the second laser beam 51 may be set such that the energy applied onto the movable debris 32 leads to a deformation of the movable debris 32.

Method 110 continues with operation 105, in which the movable debris 32 is trapped in the energy field 50. In some embodiments, the operations 101 to 105 can be performed simultaneously. In some embodiments, the energy field 50 formed by the second laser beam 51 includes the beam waist (not shown), and the movable debris 32 is attracted to the beam waist.

Method 110 continues with operation 106, in which the trapped movable debris 32 is purged. In some embodiments, operation 106 includes providing a purge gas 24, and purging the trapped movable debris 32 with the purge gas 24. In some embodiments, the purge gas 24 is clean dry air (CDA) or nitrogen gas ($N_2$). In some embodiments, the chamber 20 includes a gas inlet 22 and a gas outlet 23. The gas inlet 22 and gas outlet 23 are configured to provide entry and exit, respectively, for the purge gas 24. In some embodiments, additional components may also be enclosed in the chamber 20, but the disclosure is not limited thereto.

Figure 5:
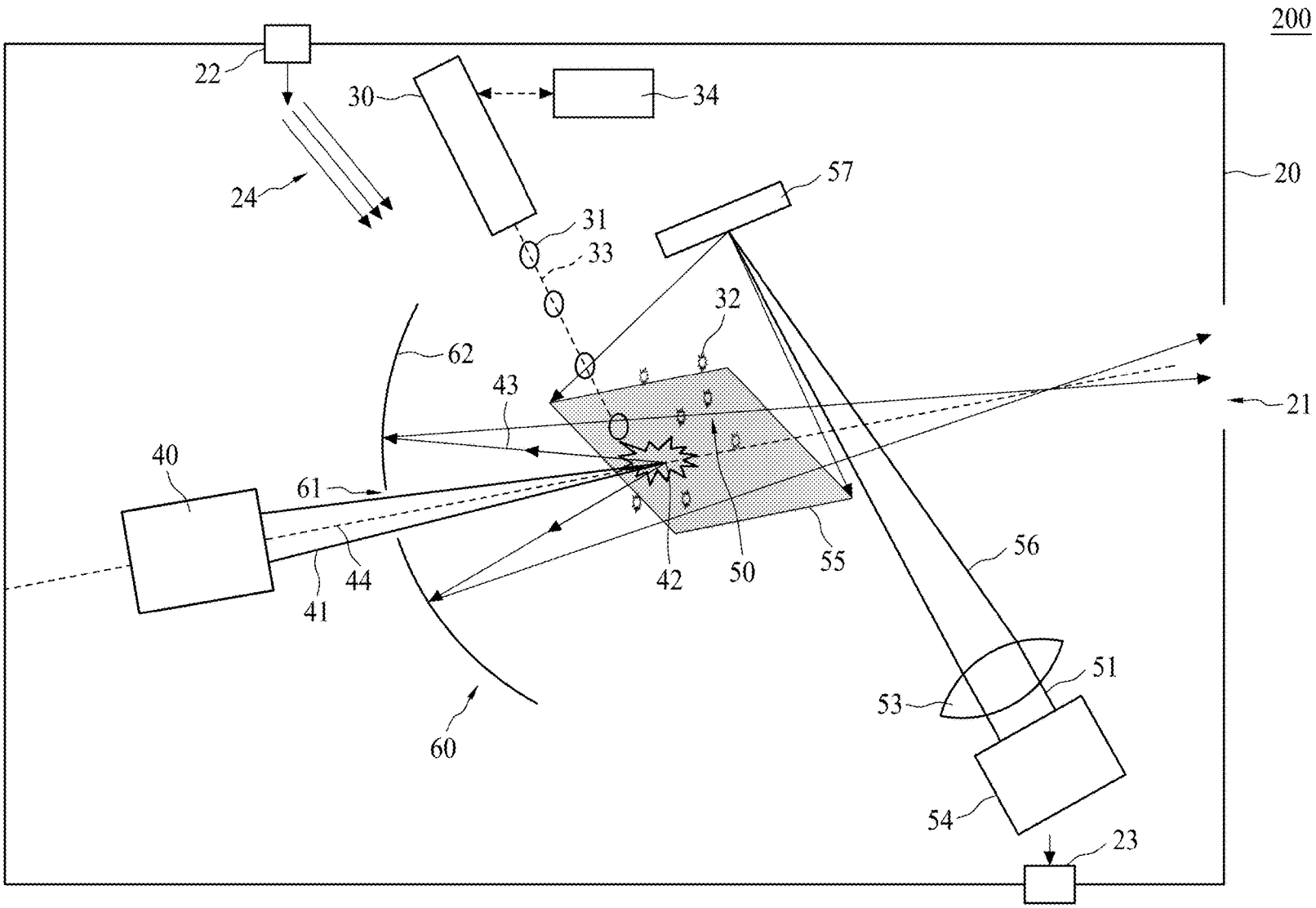
FIG. 5 is an illustration of an EUV radiation source according to aspects of the present disclosure in one or more embodiments.

FIG. 5 illustrates an EUV radiation source, which can be used to implement either method 100 or method 110 and which represents another embodiment of the present disclosure. Referring to FIG. 5, in some embodiments, after the second laser beam 51 passes through the first optical element 53 to obtain a highly focused laser beam 56, the highly focused laser beam 56 is reflected by a second optical element 57 to form an image 55 of the energy field 50.

In some embodiments, the second optical element 57 is configured to modulate the highly focused laser beam 56 to form the image 55. In some embodiments, the second optical element 57 is an optical modulator. In some embodiments, the second optical element 57 is a spatial light modulator (SLM). An SLM shall be used herein to refer to a two-dimensional device for modifying optical properties of the second laser beam 51 on the modulator surface in order to encode holographic information of the image 55. Depending on the type of encoding, amplitude-only, phase-only or simultaneous phase and amplitude modulation of the second laser beam 51 are possible. In some embodiments, the amplitude and/or phase modulation does not have to be effected directly, but can also be realized through additional components, such as polarizers, which modify other properties of the second laser beam 51, such as its polarization. In some embodiments, an SLM is formed by a two-dimensional array of individually addressable modulator cells (pixels). In some embodiments, the modulator cells can, for example, be addressed electrically or optically. In some embodiments, the modulator cells can emit light by themselves controllably or can work in transmissive or reflective mode to modulate the second laser beam 51 controllably. In some embodiments, it is also possible to achieve a wavelength conversion of the modulated second laser beam 51. In some embodiments, the modulator cells can, for example, be addressed electrically or optically. In some embodiments, it is also possible to achieve a wavelength conversion of the modulated second laser beam 51.

In some embodiments, an SLM is a computer-controlled electronic liquid-crystal device, which can create dynamic vortices, arrays of vortices, and other types of beams by creating a hologram of varying refractive indices, but the disclosure is not limited thereto. In some embodiments, the hologram may be a fork pattern, a spiral phase plate, or some similar pattern with non-zero topological charge.

In some embodiments, an SLM can be formed by a one-dimensional scanning device of a one-dimensional SLM, for example of a one-dimensional grating light valve (GLV), or by a two-dimensional scanning device of a point-shaped light modulator, for example of a laser beam source. In some embodiments, the SLM may create multiple laser beams from a single input second laser beam 51.

Figure 6:
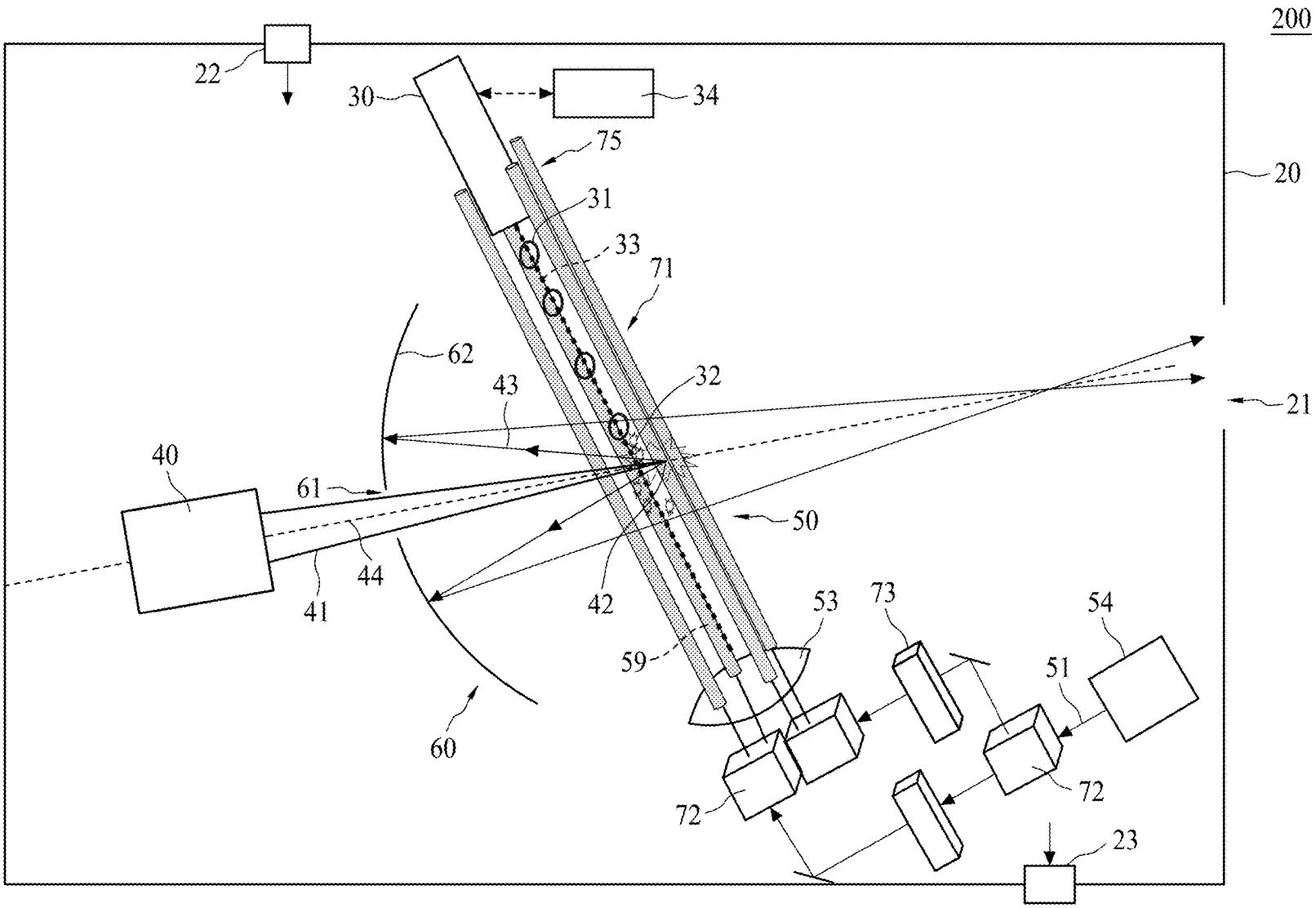
FIG. 6 is an illustration of an EUV radiation source according to aspects of the present disclosure in one or more embodiments.

FIG. 6 illustrates an EUV radiation source 200, which can be used to implement either method 100 or method 110, and which represents another embodiment of the present disclosure. Referring to FIG. 6, in some embodiments, the energy field 50 includes a three-dimensionally configured optical column configured to trap the movable debris 32. In some embodiments, the movable debris 32 is trapped in a three-dimensionally configured optical column. In some embodiments, the movable debris 32 is trapped in a vortex beam column 71. In some embodiments, method 100 or method 110 further includes introducing the vortex beam column 71 into the chamber 20, and trapping the movable debris 32 in the vortex beam column 71.

In some embodiments, the vortex beam column 71 is formed by the second laser beam 51. In some embodiments, the second laser beam 51 is passed through at least one beam splitter 72 and split into multiple laser beams, and the multiple laser beams are passed through the first optical element 53 to form the vortex beam column 71. In some embodiments, the second laser beam 51 is further passed through a hologram lens 73 for splitting and expanding. In some embodiments, the second laser beam 51 is passed through the hologram lens 73 for splitting and expanding before being passed through the beam splitter 72.

In some embodiments, the vortex beam column 71 is arranged along an axis 74. In some embodiments, the axis 74 of the vortex beam column 71 is the same as the first trajectory 33 of the fuel droplets 31, such that the movable debris 32 may be trapped in the vortex beam column 71 once the movable debris 32 has formed and the movable debris 32 may not splash around the chamber 20. In some embodiments, the axis 74 of the vortex beam column 71 is different from the first trajectory 33 of the fuel droplets 31.

In some embodiments, the trapping of the movable debris 32 in the vortex beam column 71 creates an effect similar to the effect created by the trapping of the movable debris 32 in the energy field 50. In some embodiments, the trapped movable debris 32 in the vortex beam column 71 is subjected to a force that is directed away from the first optical element 53 along the axis 74 of the vortex beam column 71. In some embodiments, the force may move the trapped movable debris 32 within the vortex beam column 71. In some embodiments, the force may transfer the trapped movable debris 32 to an area that does not affect the generation of EUV radiation 43.

Figure 7:
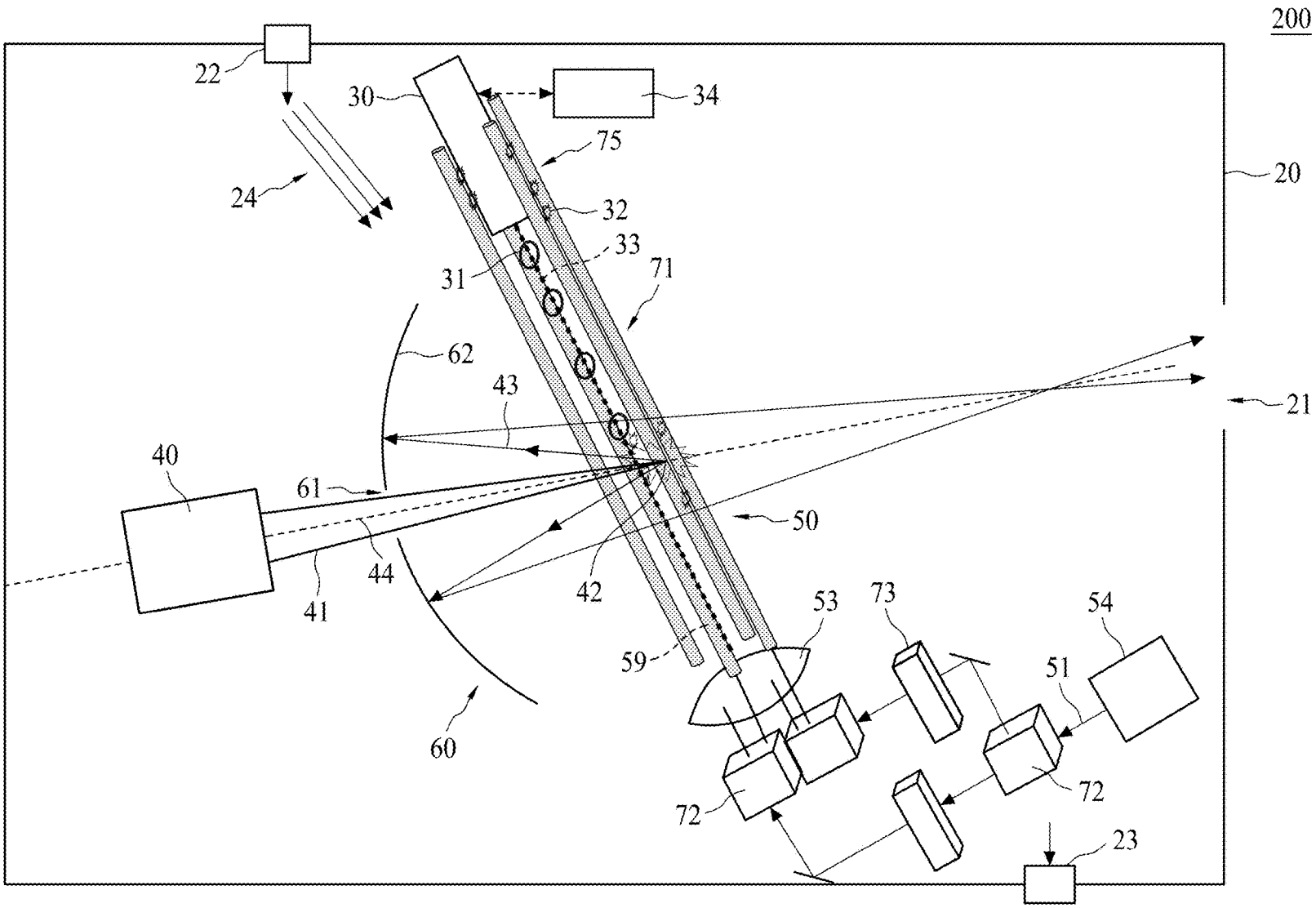
FIG. 7 is an illustration of an EUV radiation source according to aspects of the present disclosure in one or more embodiments.

FIG. 7 illustrates an EUV radiation source 200, which can be used to implement either process 100 or process 110, and which represents another embodiment of the present disclosure. Referring to FIG. 7, in some embodiments, method 100 or method 110 further includes transferring the trapped movable debris 32 in the vortex beam column 71 to a holding area 75. In some embodiments, the holding area 75 is an area that does not affect the generation of EUV radiation 43.

In some embodiments, when the holding area 75 gathers a predetermined amount of movable debris 32, the purge gas 24 is provided to purge the trapped movable debris 32.

Accordingly, the present disclosure therefore provides a method for generating EUV radiation and an EUV radiation source. The method for generating EUV radiation includes forming an energy field proximal to the location of the first laser beam strike to trap the movable debris. Consequently, the movable debris can be trapped without contaminating the collector.

In some embodiments, a method for generating extreme ultraviolet (EUV) radiation is provided. The method includes introducing a fuel droplet into a chamber, applying a first laser beam to strike the fuel droplet at a location to generate EUV radiation and form a movable debris of the fuel droplet, and forming an energy field proximal to the location of the first laser beam strike to trap the movable debris.

In some embodiments, another method for generating extreme ultraviolet (EUV) radiation is provided. The method includes introducing a fuel droplet into a chamber, applying a first laser beam to strike the fuel droplet at a location to generate EUV radiation and form a movable debris of the fuel droplet, and forming an energy field proximal to the location of the first laser beam strike to trap the movable debris. The method further includes accelerating the movable debris toward the energy field, trapping the movable debris in the energy field, and purging the trapped movable debris.

In some embodiments, an extreme ultraviolet (EUV) radiation source is provided. The EUV radiation source includes a fuel droplet generator configured to provide a fuel droplet to a chamber, and a first laser configured to generate a first laser beam to strike the fuel droplet at a location to generate EUV radiation and form a movable debris of the fuel droplet. The EUV radiation source further includes a collector configured to reflect the EUV radiation toward an exit aperture of the chamber, and an energy field configured to trap the movable debris, wherein the energy field is proximal to the location of the first laser beam strike.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A method for generating extreme ultraviolet (EUV) radiation, comprising:

introducing a fuel droplet into a chamber;

applying a first laser beam to strike the fuel droplet at a location to generate EUV radiation and form a movable debris of the fuel droplet; and forming an optical trap proximal to the location of the first laser beam strike to trap the movable debris in the optical trap.

2. The method of claim 1, further comprising accelerating the movable debris to a speed greater than a predetermined speed.

3. The method of claim 1, further comprising providing a purge gas, and purging the trapped movable debris with the purge gas.

4. The method of claim 3, wherein the purge gas is clean dry air or nitrogen gas.

5. A method for generating extreme ultraviolet (EUV) radiation, comprising introducing a fuel droplet into a chamber;

applying a first laser beam to strike the fuel droplet at a first location to generate EUV radiation and form a movable debris of the fuel droplet;

collecting the EUV radiation;

forming an optical trap proximal to the first location of the first laser beam strike to trap the movable debris;

accelerating the movable debris toward the optical trap;

trapping the movable debris in the optical trap and keeping the movable debris in a second location proximal to the first location; and purging the trapped movable debris out of the chamber from the second location.

6. An extreme ultraviolet (EUV) radiation source, comprising:

a fuel droplet generator configured to provide a fuel droplet to a chamber;

a first laser configured to generate a first laser beam to strike the fuel droplet at a first location to generate EUV radiation and form a movable debris of the fuel droplet;

a collector configured to reflect the EUV radiation toward an exit aperture of the chamber; and an optical trap configured to trap the movable debris and keep the movable debris in a second location proximal to the first location, wherein the optical trap is proximal to the first location of the first laser beam strike.

7. The extreme ultraviolet (EUV) radiation source of claim 6, further comprising a second laser beam configured to accelerate the movable debris and move the movable debris.

8. The method of claim 1, wherein the optical trap is generated by focusing a second laser beam.

9. The method of claim 8, wherein the wavelength of the second laser beam is different from the wavelength of the first laser beam.

10. The method of claim 1, wherein introducing the fuel droplet, applying the first laser beam to strike the fuel droplet, and forming the optical trap are performed simultaneously.

11. The method of claim 5, wherein introducing the fuel droplet, applying the first laser beam to strike the fuel droplet, collecting the EUV radiation, forming the optical trap, and accelerating the movable debris are performed simultaneously.

12. The method of claim 5, wherein the EUV radiation is collected by being reflected by a collector.

13. The method of claim 12, further comprising passing the first laser beam through an opening of the collector before the first laser beam strikes the fuel droplet at the first location.

14. The method of claim 5, wherein the optical trap is generated by focusing a second laser beam, wherein the wavelength of the second laser beam is different from the wavelength of the first laser beam.

15. The method of claim 5, wherein the trapped movable debris is purged with a purge gas.

16. The method of claim 15, wherein the purge gas is clean dry air or nitrogen gas.

17. The extreme ultraviolet (EUV) radiation source of claim 6, further comprising:

a gas inlet configured to provide entry for a purge gas to purge the movable debris.

18. The extreme ultraviolet (EUV) radiation source of claim 17, further comprising:

a gas outlet configured to provide exit for the purge gas.

19. The extreme ultraviolet (EUV) radiation source of claim 6, wherein the optical trap is formed by a second laser beam, wherein the optical trap formed by the second laser beam is configured to accelerate the movable debris, move the movable debris, and trap the movable debris.

20. The method of claim 1, wherein the optical trap has a gradient of intensity and a strongest region of the optical trap is at the center of a beam waist.

* * * * *